United States Patent [19]

Trammel

[11] 4,077,246

[45] Mar. 7, 1978

[54] PERCUSSION CAP FORMING TOOL

[76] Inventor: Gary Lee Trammel, 5540 Walnut Ave., Long Beach, Calif. 90805

[21] Appl. No.: 709,279

[22] Filed: Jul. 28, 1976

[51] Int. Cl.[2] ..... B21D 51/54; B21D 45/00

[52] U.S. Cl. ..... 72/328; 29/1.3; 72/344; 113/116 V

[58] Field of Search ..... 72/325, 326, 327, 328, 72/344, 348, 370, 379, 418; 29/1.3, 1.31, 1.1, 1.11, 1.2, 1.21, 1.22, 1.23; 113/116 V

[56] References Cited

U.S. PATENT DOCUMENTS

| | | | |
|---|---|---|---|
| 2,979,188 | 4/1961 | Duffield | 72/328 |
| 2,985,128 | 5/1961 | Henrickson | 72/328 |
| 3,336,117 | 8/1967 | Borello | 72/379 |
| 3,998,086 | 12/1976 | Hoenig | 72/325 |

FOREIGN PATENT DOCUMENTS

| | | | |
|---|---|---|---|
| 546,567 | 9/1957 | Canada | 72/328 |
| 2,456,160 | 5/1975 | Germany | 72/325 |

*Primary Examiner*—Michael J. Keenan

[57] ABSTRACT

A small percussion cap making tool consisting of a Cutter and a Cutting Block. The Cutter is multi-toothed with an internal forming cone, a shoulder to release the finished caps and a cap exit passage. The Cutting Block has a guide for the Cutter, a material feeding slot and a centered mandrel that works in conjunction with the Cutter's forming cone to form the percussion caps. The percussion cap material is placed in the feeding slot and the Cutter is driven downward. On the downward stroke the material is wrinkled, cut, folded and formed into a percussion cap. Extraction of the Cutter from the Cutting Block pulls the cap free of the mandrel so it can be retrieved from the cap exit passage in the Cutter. The percussion cap may then be charged with a priming mixture and used.

3 Claims, 8 Drawing Figures

PERCUSSION CAP FORMING TOOL

BACKGROUND OF THE INVENTION

A. Field of the Invention

Percussion caps are used to ignite the propellent powder charges of the caplock firearms of 19th Century design. Percussion caps are small cup-like primers.

B. Description of Prior Art

Until this time, cap manufacture was done by companies with expensive hot-forming or cut-pattern-forming machinery. The problems with straight walled and solid walled percussion caps made by these processes are eliminated by the new invention.

SUMMARY

The PERCUSSION CAP FORMING TOOL is a small, simple tool utilized by the private antique gun shooter to make his own percussion caps from aluminum beverage cans.

DRAWINGS

All drawings are twice scale except FIG. 7 and FIG. 8 which are greatly enlarged to show detail.

Figure 7:
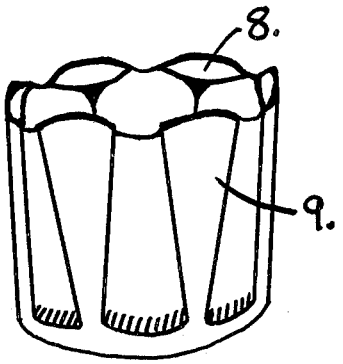

FIG. 7 displays the percussion cap produced by the new tool and shows one of the Skirt Orifices 8 and one of the Skirt Folds 9.

Figure 8:
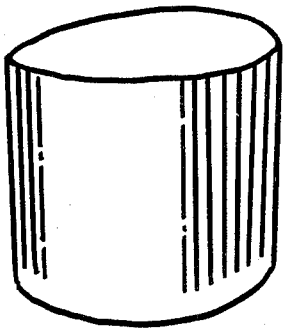

FIG. 8 shows a standard percussion cap with the conventional straight skirt for comparison.

DESCRIPTION

The PERCUSSION CAP FORMING TOOL is constructed of steel, or a suitably hard material may be used. The specifications set forth here produce the #11 size percussion caps, but different sizes may be produced by the same design. The PERCUSSION CAP FORMING TOOL consists of two parts; the Cutter and the Cutting Block. The 7/16 inch diameter Cutter is $1\frac{1}{2}$ inches long with 12 evenly spaced teeth that are $\frac{1}{8}$ inch to 3/16 inch in length, and a 1 inch diameter Extraction Knob 1. The internal working surfaces of the Cutter consist of a Forming Cone 6 that tapers from 7/16 inch diameter to 13/64 inch diameter in $\frac{1}{2}$ inch of travel, and a Cap Release Shoulder 5 that is formed by the difference of the diameters of the small end of the Forming Cone 6 and the Cap Exit Passage 4. The 1 inch diameter Cutting Block consists of a 7/16 inch diameter, $1\frac{3}{4}$ inch long Cutter Guide 10, and a 5/32 inch diameter mandrel 7 that is threaded bottom center in the Cutter Guide 10, and a 1/32 inch Feeding Slot 3 that extends $\frac{1}{8}$ inch past the Cutter Guide 10.

Figure 1:
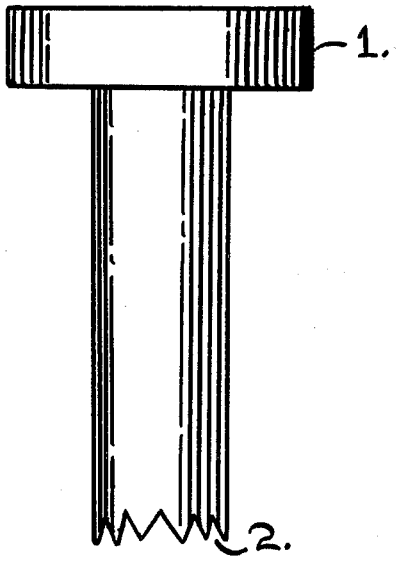
FIG. 1 is an external view of the Cutter showing the Extraction Knob 1 and the Teeth 2.
Figure 2:
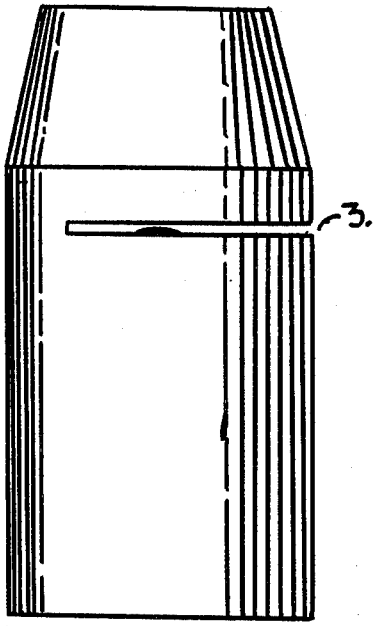
FIG. 2 is an external view of the Cutting Block showing the Feeding Slot 3.
Figure 3:
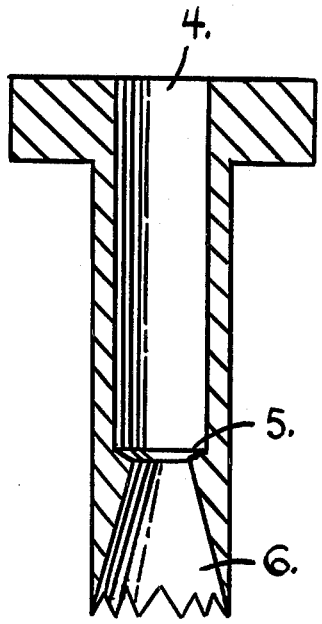
FIG. 3 is an internal view of the Cutter showing the Cap Exit Passage 4, the Cap Release Shoulder 5 and the Forming Cone 6.
Figure 4:
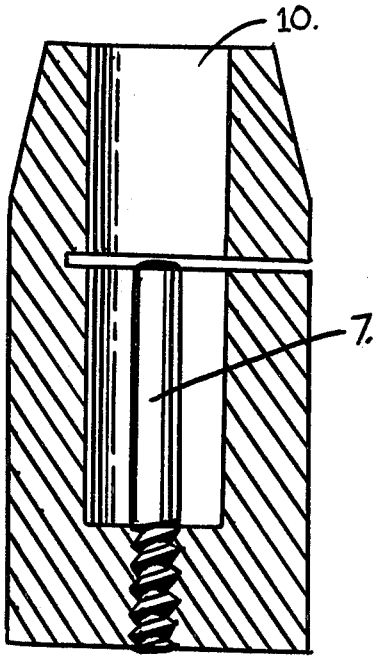
FIG. 4 is an internal view of the Cutting Block showing the Mandrel 7 and the Cutter Guide 10.
Figure 5:
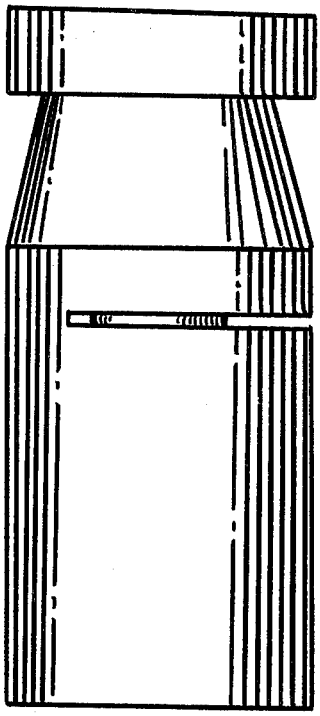
FIG. 5 is an external view of the two parts of the tool mated.
Figure 6:
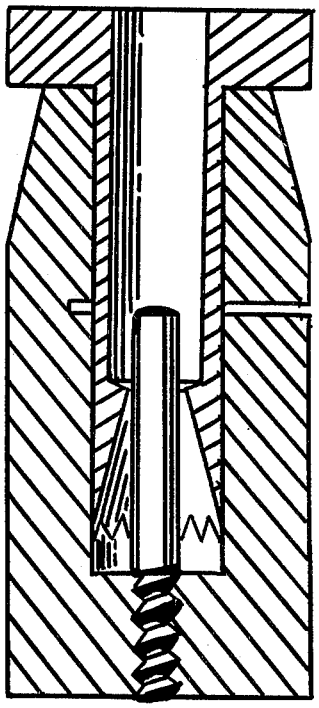
FIG. 6 is an internal view of the two parts of the tool mated.

Aluminum beverage can material, thin guage aluminum, copper or brass is placed in the Feeding Slot of the Cutting Block, and the Cutter positioned in the Cutter Guide. By driving the Cutter downward into the Cutting Block, the 12 teeth wrinkle uniformly and cut out a disc from the material. The advancing Mandrel forces the wrinkled disc through the Forming Cone which progressively forms the soft metal into the finished cap around the tip of the Mandrel. When the Cutter is extracted from the Cutting Block, the skirt of the cap encounters the Cap Release Shoulder and is pulled free of the Mandrel. The cap can then be retrieved from the Cap Exit Passage. Note the relationship of the various components in FIG.6. The finished percussion cap is then primed with an explosive compound and is ready for use.

The percussion caps produced by this process differ considerably from conventional caps. The flexibility of the folded skirt facilitates a snug fit on varying sizes of percussion gun nipples. When the gun is fired, the folded-skirt cap uniformly flares out like an umbrella. The six Skirt Orifices 8, and the six Skirt Folds 9 allow this consistent flexibility. This is a very desirable characteristic on percussion revolvers because the flared caps softly wedge themselves into the nipple recess of the cylinder and remain there until they are removed by the shooter. There has always been a problem with fired conventional percussion caps falling off the nipples and jamming the revolver cylinder or the hammer while firing subsequent shots. The new folded-skirt percussion caps eliminate these problems, and using aluminum beverage can material as the cap material adds to the improvement as it has superior working characteristics and functioning characteristics in this application. The soft aluminum can material and other aluminum stock emphasize the flaring action of the new-design caps.

The PERCUSSION CAP FORMING TOOL will be manufactured and marketed nationwide for the benefit of interested percussion gun shooters.

I claim:

1. A tool for forming percussion caps from a metal sheet in one operating cycle, comprising a cutting block and a cutter which are reciprocable toward and away from engagement with each other, said cutting block including a stationary mandrel which is centered within the cylindrical walls of a female cutter guide, said mandrel extending to a feeding slot which perpendicularly traverses said cutter guide, said cutter being cylindrical with multiple cutting teeth along its edge periphery and including an internal forming cone, the larger end of said forming cone originating at said cutting teeth and tapering inwardly within the cutter to a smaller orifice diameter and terminating in a shoulder at that point, said shoulder being formed by the junction of the small-orifice end of said forming cone and a larger cap exit passage to the exterior of the cutter, said cutter being snugly slidable within said cutter guide thereby properly aligning and positioning the mating surfaces of the tool, said cutting teeth acting during tool engagement to uniformly wrinkle and cut a disc from a metal sheet positioned in said feeding slot, said mandrel then cooperating with said forming cone to form said disc into a percussion cap therebetween, said percussion cap being formed onto the tip of said mandrel and projected past the end of said forming cone into said cap exit passage prior to the bottoming of the mechanism, said percussion cap being pulled free of said mandrel by said shoulder upon disengagement of the tool components.

2. A tool for forming percussion caps from a metal sheet in one operating cycle, comprising a cutter with multiple cutting teeth on its peripheral edge and a cutting block, one of which is movable toward and away from the other, said cutter being snugly slidable within a guide located in said cutting block, said cutting block including a stationary mandrel mounted in the center of said guide and axially aligned to said cutter, said guide being perpendicularly divided by a feeding slot which coincides with the tip of said mandrel, said cutter having an internal forming cone which tapers inwardly from said peripheral edge to a reduced diameter therein, the reduced end of said forming cone joining a larger passage in the cutter thereby forming a shoulder at that junction, the cutting teeth and said cutting block acting together upon engagement of the tool to uniformly wrinkle and punch a disc from a metal sheet prepositioned in said feeding slot, the aforementioned metal disc being pushed through and beyond said forming cone by said mandrel to form a percussion cap on the tip of said mandrel, said mandrel cooperating with said shoulder to release the percussion cap when the tool components are drawn apart.

3. A tool for forming percussion caps from a metal sheet in a single operating cycle, comprising a cutter and a cutting block, one of which is movable to and from engagement with the other, said cutter being a cylinder with cutting teeth on its peripheral edge and including a female forming cone, the orifice of said forming cone beginning at said peripheral edge and tapering to a smaller diameter within the body of the cutter, the smaller end of said forming cone having a junction with a larger sized cap exit passage to the outside of the cutter, said junction forming a shoulder thereat, said cutting block including a cylindrical female cutter guide which is traversed by a feeding slot perpendicular to its axis, said cutter guide having a fixed mandrel centrally located therein and parallel therewith, said mandrel extending to the opening of said feeding slot, said cutter mating with said cutting block by fitting closely and slidably within said cutter guide thereby being axially aligned with said mandrel and positioned squarely relative to said feeding slot, said cutting teeth acting in conjunction with said cutting block during tool operation to punch a uniformly wrinkled disc out of a metal sheet seated in said feeding slot, said forming cone drawing said metal disc into a percussion cap around the tip of said mandrel, said percussion cap clearing the end of said forming cone and completely entering said cap exit passage before completion of tool engagement, said percussion cap being pushed off the end of the mandrel by said shoulder when tool operation is reversed.

* * * * *